US005221124A

United States Patent [19]

Nichols

[11] Patent Number: 5,221,124

[45] Date of Patent: Jun. 22, 1993

[54] METHOD TO MANUFACTURE A WET MOP HEAD

[75] Inventor: James B. Nichols, Lagrange, Ga.

[73] Assignee: Milliken Research Corporation, Spartanburg, S.C.

[21] Appl. No.: 759,834

[22] Filed: Sep. 13, 1991

Related U.S. Application Data

[62] Division of Ser. No. 728,525, Jul. 11, 1991.

[51] Int. Cl.[5] ..... A46D 1/04

[52] U.S. Cl. ..... 300/21

[58] Field of Search ..... 300/16, 21; 15/229.1, 15/229.2, 229.3, 228; 156/250, 269

[56] References Cited

U.S. PATENT DOCUMENTS 1,855,400 4/1932 Krebs .
2,320,372 6/1943 McCarthy ..... 300/21 X
3,115,658 12/1963 Moss .
3,696,460 10/1972 Moss .
4,313,774 2/1982 Arthur .
4,717,616 1/1988 Harmon et al. .
4,995,133 2/1991 Newell .
5,027,468 7/1991 Leventhal et al. .

*Primary Examiner*—Mark Rosenbaum
*Assistant Examiner*—Kenneth J. Hansen
*Attorney, Agent, or Firm*—Earle R. Marden; Terry T. Moyer

[57] ABSTRACT

Method to form a wet mop head from a circular knit interlock by cutting the fabric into a plurality of sections and slitting the ends of each section. Then stacking a plurality of sections one on top the other than wrapping a tape centrally therearound to form a wet mop head when the tape is stitched to the stacked sections.

4 Claims, 1 Drawing Sheet

METHOD TO MANUFACTURE A WET MOP HEAD

This is a division of application Ser. No. 728,525 filed Jul. 11, 1991 for IMPROVED WET MOP.

This invention relates generally to mops used to swab large surfaces to clean up spills and dirt and in particular to wet mops employing strip materials in construction thereof rather than yarns.

In prior art wet mops individual or plied yarns were tufted, bonded or otherwise connected in a group to provide a plurality of moisture absorbing surfaces in order to clean a dirty surface such as a floor. It has been found that this type of mop is difficult to control during manufacturing and tends to lint during use.

Therefore, it is an object of the invention to provide a new and improved wet mop made from a plurality of interconnected fabric strips which cooperate together to provide a moisture absorbent mop.

Other objects and advantages of the invention will become readily apparent as the specification proceeds to describe the invention with reference to the accompanying drawing in which.

Figure 1:
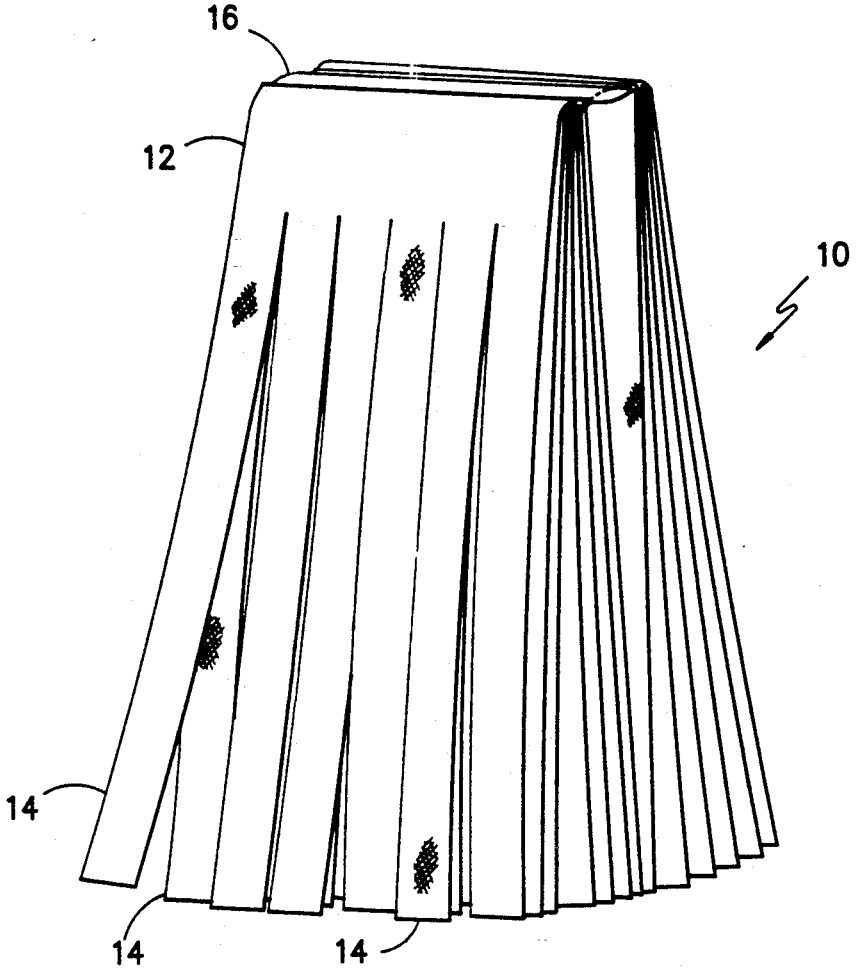
FIG. 1 is a perspective view of the new and improved mop head.
Figure 2:
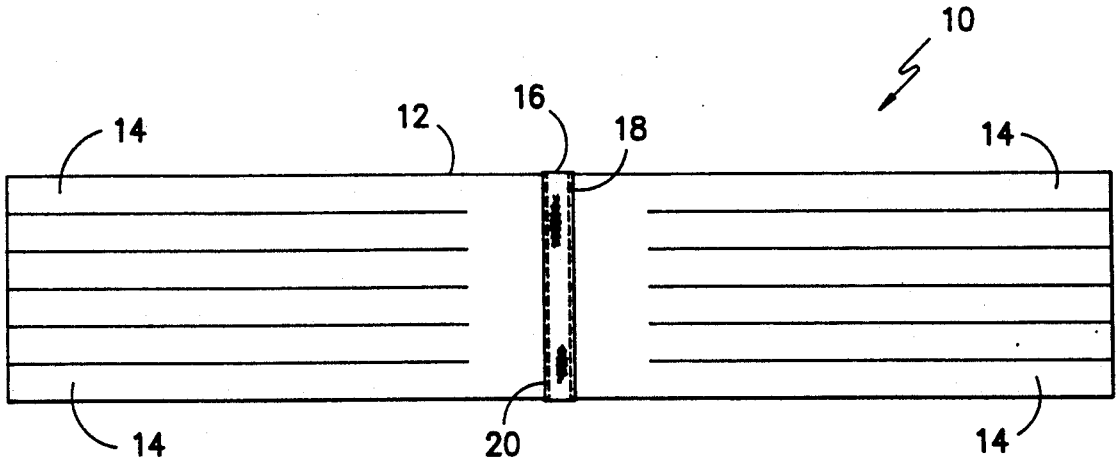
FIG. 2 is a top view of the mop head of FIG. 1 laid out in a flat position.

Looking now to the drawing, the reference number 10 represents the new and novel mop head consisting of a plurality of strips 12 of interlock jersey knit fabric slit at each end thereof to form elongated fingers 14. A pre-selected number of strips, such as twenty, are laid one on top of the other and connected centrally by a band 16 wrapped therearound and stitched along lines spaced 18 and 20.

The preferred method of manufacturing the above-described mop head 10 is as follows. First a plurality of ends of 1/70/33 polyester yarn are knit into tubular shaped on an interlock circular knitting machine and taken up on a take-up roll. Then the tubular knit fabric is slit, opened up into a flat shape, dried, washed, scoured, treated while wet and then heat-set. After it has been heat set, the fabric is cut into 6½" wide, 35" long sections 12. Then each section 12 is slit to form the fingers 14. Each finger 14 is approximately 15" long and 1" wide. After the fingers have been slit a plurality, preferably 20, of the sections 12 are piled on top of one another. Then the tape (1¼"–4" in width) is placed around the central portion of the mop head 10 and stitched along the lines 18 and 20 to form the mop head. The tape portion 16 forms the connecting area for the mop handle to complete the wet mop for use.

The above dimensions including length, width, slit length and tape size are merely preferred since other dimensions can be used, if desired, so long as the preferred construction is maintained. It is obvious that a wet mop construction has been described which employs the use of a knit fabric to provide stability and strength without excessive linting during use. As discussed, it is preferred that the basic fabric be circular knit but other types of knit fabric such as tricot, Raschel, etc. can be used, if desired. Also if desired, the fingers of the mop can be connected together in any suitable manner such as by stitching.

Other embodiments can be used within the scope of the described invention and therefore it is requested that the scope of the invention be determined only by the scope of the claims.

I claim:

1. The method of manufacturing a wet mop head comprising: providing a knit fabric, cutting the knit fabric into a plurality of substantially equal size sections, slitting both ends of each section to form a plurality of fingers, stacking a plurality of the fingered sections one on top of the other and stitching a tape around and centrally of each stack of sections to form a wet mop head.

2. The method of claim 1 wherein the knit fabric is circular knit and is slit and opened prior to the formation of the sections.

3. The method of claim 2 wherein the slit fabric is dried and heat-set prior to the cutting of the fabric into sections.

4. The method of claim 3 wherein the knit fabric is substantially 100% polyester.

* * * * *